US008083480B2

(12) United States Patent
Liang et al.

(10) Patent No.: US 8,083,480 B2
(45) Date of Patent: Dec. 27, 2011

(54) COOLING FAN

(75) Inventors: Bao-Hua Liang, Shenzhen (CN); Yong-Kang Zhang, Shenzhen (CN); Hong Sun, Shenzhen (CN); Ying-Min Huang, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 1048 days.

(21) Appl. No.: 11/955,297

(22) Filed: Dec. 12, 2007

(65) Prior Publication Data

US 2009/0053063 A1 Feb. 26, 2009

(30) Foreign Application Priority Data

Aug. 24, 2007 (CN) ..... 2007 1 0076557

(51) Int. Cl.
*F04D 29/06* (2006.01)

(52) U.S. Cl. ..... 415/213.1; 415/216.1; 415/220; 415/229; 416/174

(58) Field of Classification Search ..... 415/213.1, 415/216.1, 220, 229; 416/174
See application file for complete search history.

(56) References Cited

U.S. PATENT DOCUMENTS

| | | | | |
|---|---|---|---|---|
| 5,176,509 | A * | 1/1993 | Schmider et al. | 417/423.7 |
| 5,997,265 | A * | 12/1999 | Chung | 417/423.13 |
| 6,318,976 | B1 * | 11/2001 | Hsieh | 417/423.12 |
| 7,364,403 | B2 | 4/2008 | Wu et al. | |
| 7,695,256 | B2 * | 4/2010 | Horng et al. | 417/420 |

FOREIGN PATENT DOCUMENTS

| | | |
|---|---|---|
| CN | 2374676 Y | 4/1999 |
| CN | 2374676 Y | 4/2000 |
| CN | 02293410.3 | 12/2003 |
| TW | 492520 | 6/2002 |
| TW | 581160 | 3/2004 |
| TW | M309142 | 4/2007 |

* cited by examiner

*Primary Examiner* — Igor Kershteyn
(74) *Attorney, Agent, or Firm* — Altis Law Group, Inc.

(57) ABSTRACT

A cooling fan includes a fan housing (10) having a shaft seat (16) extending downwardly therefrom, a stator (20) being fixedly mounted around the shaft seat, a shaft (80) with a top end being fixedly connected to the shaft seat and a free end (82) extending downwardly therefrom, a rotor (30) comprising a hub (32) having a plurality of blades (34) extending radially and outwardly, and a sleeve bearing (40). A fixing tube (36) extends upwardly from a center of the hub. The fixing tube has a closed bottom end and defines a fixing hole (360) therein. The sleeve bearing is fixedly received in the fixing hole of the fixing tube to rotate with the rotor. A bearing hole is defined in the sleeve bearing for extension of the free end of the shaft therethrough.

8 Claims, 1 Drawing Sheet

COOLING FAN

BACKGROUND OF THE INVENTION

1. Field of the Invention

The present invention relates to a cooling fan, and more particularly relates to a sleeve bearing of the cooling fan having good lubricating characteristics.

2. Description of Related Art

With the continuing development of the electronic technology, electronic packages such as CPUs (central processing units) are generating more and more heat that is required immediate dissipation. Cooling fans are commonly used in combination with heat sinks for cooling CPUs. Cooling fan performance mostly depends on performance characteristics of bearings used. Good lubricating qualities of the bearings increase the life-span of the bearings.

A conventional cooling fan includes a rotor having a stainless rotary shaft extending downwardly from a central portion thereof, a sleeve bearing defining an inner hole receiving the shaft therein, and a frame forming a central tube at a middle portion thereof receiving the bearing therein. The sleeve bearing is made of sintered metal powders and has a plurality of pores impregnated with lubricant oil. However, the cooling fan is usually arranged to be upended, and thus the rotor is arranged under the frame. An open end of the central tube is thus located at the bottom of the central tube and opened downwards. The lubricant oil impregnated in the bearing is thus easily to flow out the bearing due to gravity. In addition, since the amount of pores in the sleeve bearing is limited by the sintering process, the amount of the lubricant oil which can be impregnated in the bearing is also limited. Thus, after a period of time of use of the cooling fan, the lubricant oil in the sleeve bearing flows out the sleeve bearing through the open bottom end of the central tube under the influence of gravity and is lost; the lubricant oil of the sleeve bearing is thus gradually diminished. Accordingly, after a period of time, the rotary shaft and the sleeve bearing will experience wear due to the leakage of the lubricant oil contained in the bearing. As a result, the performance of the cooling fan is deteriorated, and the life-span thereof is shortened.

Therefore, it is desirable to provide a cooling fan wherein one or more of the foregoing disadvantages may be overcome or at least alleviated.

SUMMARY OF THE INVENTION

According to a preferred embodiment of the present invention, a cooling fan comprises a fan housing, a stator, a rotor, and a sleeve bearing. The fan housing has a shaft seat extending downwardly therefrom. The stator is fixedly mounted around the shaft seat of the fan housing. The shaft has a top end being fixedly connected to the shaft seat of the housing and a free end extending downwardly therefrom. The rotor includes a hub having a plurality of blades extending radially and outwardly, and a fixing tube extending upwardly therefrom. The fixing tube has an open top end and a closed bottom end. A fixing hole is defined in the fixing tube, communicating with the open top end. The sleeve bearing is fixedly received in the fixing hole of the fixing tube to rotate with the rotor during operation of the cooling fan. A bearing hole is defined in the sleeve bearing for extension of the free end of the shaft therethrough. Thus, a bottom end of the bearing is enclosed by the fixing tube, and the lubricant oil can be kept from leaking out of the bottom of the bearing under the influence of gravity. Good lubricating quality of the bearing and shaft is consistently maintained, thereby improving the quality and life-span of the cooling fan.

Other advantages and novel features of the present invention will be drawn from the following detailed description of the preferred embodiments of the present invention with attached drawings, in which:

BRIEF DESCRIPTION OF THE DRAWINGS

Many aspects of the present cooling fan can be better understood with reference to the following drawings. The components in the drawings are not necessarily drawn to scale, the emphasis instead being placed upon clearly illustrating the principles of the present cooling fan. Moreover, in the drawings, like reference numerals designate corresponding parts throughout the several views.

DETAILED DESCRIPTION OF THE INVENTION

Figure 1:
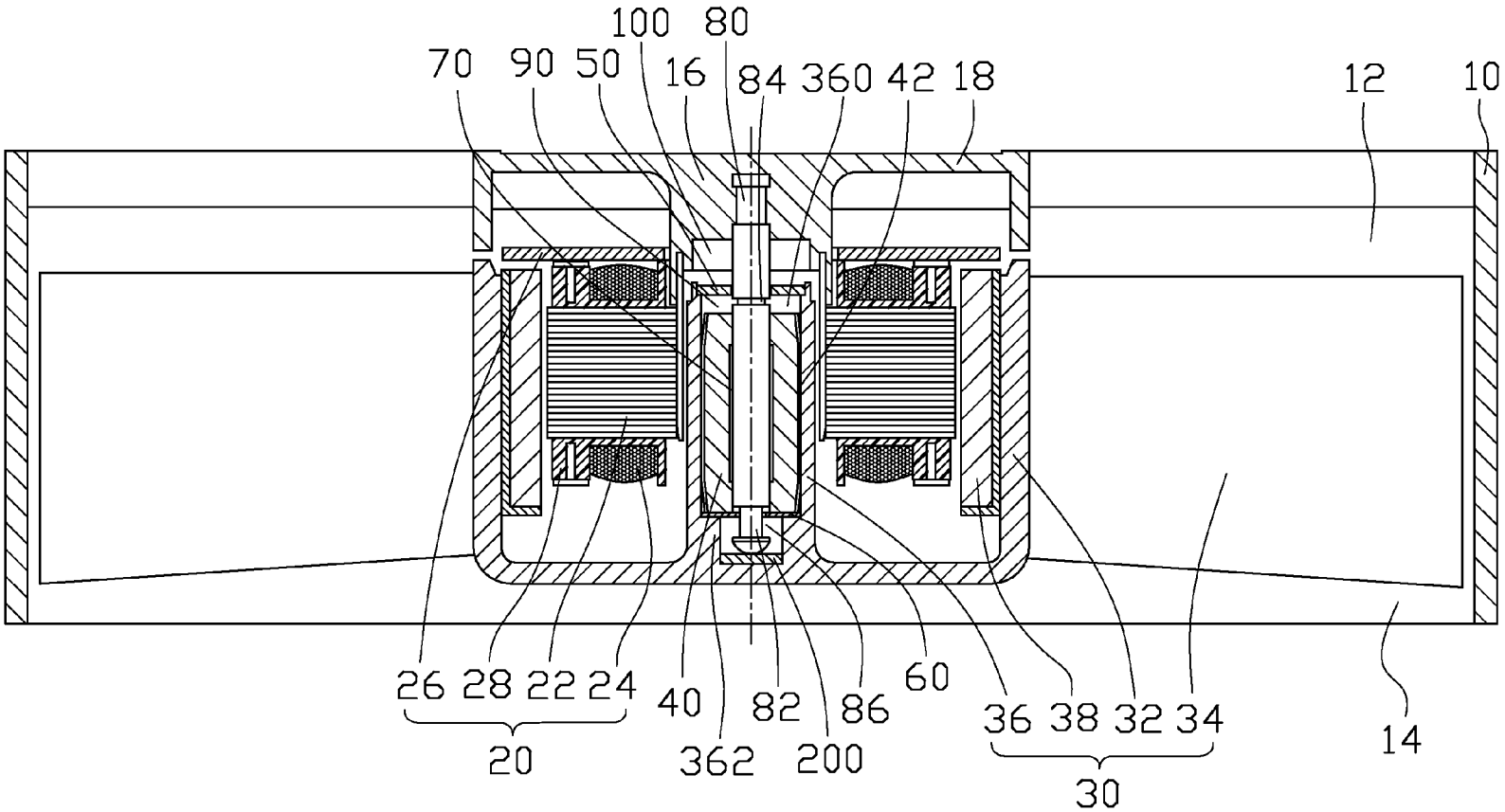
FIG. 1 is a cross sectional view of a cooling fan in accordance with a preferred embodiment of the present invention.

Referring to FIG. 1, a cooling fan according to a preferred embodiment includes a rotor 30, a stator 20 in respective to which the rotor 30 is rotatable, a fan housing 10 and a sleeve bearing 40.

The fan housing 10 is square, column-shaped. Top and bottom sides of the fan housing 10 respectively form an air inlet 12 and an air outlet 14. A base 18 is formed in a center of the fan housing 10 at the air inlet 12. A shaft seat 16 extends downwardly from a central portion of the base 18. A shaft 80 has a top end being fixedly received in a central portion of the shaft seat 16 and a free end 82 extending downwardly from the shaft seat 16. The shaft 80 defines an annular slot 84 in a circular circumference thereof, near the top end of the shaft 80 adjacent to the base 18. An annular notch 86 is defined near the free end 82 of the shaft 80 far from the base 18.

The stator 20 includes a stator core 22 consisting of layered yokes, stator coils 24 wound on the stator core 22 to establish an alternating magnetic field, and a PCB (Printed Circuit Board) 26 electrically connected with the stator coils 24. To avoid the coils 24 coming into electrical contact with the stator core 22, upper and lower insulating frames 28 are used to cover the stator core 22 and electrically insulate the stator coils 24 from the stator core 22. The stator 20 is fixedly connected to a bottom of the shaft seat 16. The PCB 26 is mounted around the shaft seat 16, and the stator core 22 is located under the shaft seat 16. Cooperatively the stator 20 and the shaft seat 16 define a circular, column-shaped innerspace 100. A top end of the innerspace 100 is closed, whilst a bottom end of the innerspace 100 is open.

The rotor 30 comprises a hub 32, a plurality of fan blades 34 extending radially and outwardly from an outer periphery of the hub 32, and a permanent magnet 38 adhered to an inner surface of the hub 32. A fixing tube 36 extends upwardly from a central portion of the hub 32. A top edge of the fixing tube 36 is approximately at the same level as that of the hub 32 of the rotor 30. The fixing tube 36 has a cross section being approximately U-shaped, which has a closed bottom end and an open top end. A fixing hole 360 is defined in a center of the fixing tube 36. An annular recess (not labeled) is formed on an inner circumference of the top end of the fixing tube 36. The recess communicates with the fixing hole 360 and has a diameter larger than that of the fixing hole 360 of the fixing tube 36. An annular protrusion 362 extends radially and inwardly from a bottom end of the fixing tube 36. The protrusion 362 has an inner diameter being smaller than the diameter of the fixing hole 360.

An oil retaining ring 50 is mounted in the recess of the fixing tube 36 and substantially encloses the open end of the fixing tube 36. The oil retaining ring 50 has an outer diameter approximately the same as the diameter of the recess of the fixing tube 36. The oil retaining ring 50 defines a mounting hole (not labeled) in a middle portion for extension of the shaft 80 therethrough. The mounting hole of the oil retaining ring 50 has a diameter being a little larger than the diameter of the shaft 80. A narrow gap with a width about 0.2 mm (Millimeter) is defined between an inner circumferential surface of the oil retaining ring 50 and an outer surface of the shaft 80. The gap thus can avoid friction generated between the oil retaining ring 50 and the shaft 80 during operation of the cooling fan.

The sleeve bearing 40 is fixedly mounted in the fixing hole 360 of the fixing tube 36 via the open end. The sleeve bearing 40 defines a bearing hole (not labeled) therein for extension of the shaft 80 therethrough. A middle portion of the bearing hole of the sleeve bearing 40 has a diameter larger than that of two opposite ends (i.e. top and bottom ends) of the bearing hole of the sleeve bearing 40. Therefore, a space 70 is defined between the middle portion of the sleeve bearing 40 and the shaft 80 when the fan is assembled to improve the supply of lubrication oil to the sleeve bearing 40. A plurality of channels 42 are defined in an outer surface of the sleeve bearing 40 for flowing back of the lubricant oil from a top of the sleeve bearing 40 to a bottom of the sleeve bearing 40. The channels 42 communicate with the bearing hole of the sleeve bearing 40, whereby the lubricant oil which has returned to the bottom of the sleeve bearing 40 can flow back to the bearing hole.

When assembled, the stator 20 is fixedly mounted around the shaft seat 16. The rotor 30 is mounted around the stator 20 with the magnet 38 facing the stator core 22 of the stator 20, and the fixing tube 36 being received in the innerspace 100 defined by the stator 20 and the shaft seat 16 cooperatively. The sleeve bearing 40 is fixedly received in the fixing hole 360 and arranged on the protrusion 362 of the fixing tube 36. The top end of the sleeve bearing 40 is lower than the top portion of the fixing tube 36. The shaft 80 extends through the bearing hole of the sleeve bearing 40 and thus rotatably engages with the sleeve bearing 40. The slot 84 of the shaft 80 is located above the top end of the sleeve bearing 40, whilst is located under the top end of the fixing tube 36. The oil retaining ring 50 is received in the recess of the top end of the fixing tube 36 and thus is located above the slot 84 of the shaft 80. Thus the oil retaining ring 50 and the sleeve bearing 40 are located at two opposite sides of the slot 84. An oil buffer 90 is defined among the oil retaining ring 50, the fixing tube 36, the shaft 80 and the sleeve bearing 40. The oil buffer 90 communicates with the slot 84 of the shaft 80 and the channels 42 of the sleeve bearing 40. A locking washer 60 is located between the bottom end of the sleeve bearing 40 and the protrusion 362 of the fixing tube 36. The locking washer 60 defines an inner hole (not labeled) with a diameter smaller than the diameter of the shaft 80, but larger than the diameter of the portion of the shaft 80 defining the notch 86. Thus the locking washer 60 is engaged in the notch 86 to limit relative motion of the shaft 80 and the sleeve bearing 40 along an axial direction thereof. A wear pad 200 made of high abrasion resistant material is mounted in a bottom end of the fixing hole 360 of the fixing tube 36 to face and supportively engage the free end 82 of the rotary shaft 80.

During operation, the rotor 30 with the sleeve bearing 40 fixedly mounted therein is driven to rotate by the interaction of the alternating magnetic field established by the stator 20 and the magnetic field established by the magnet 38 of the rotor 30. The lubrication oil creeps up along the rotating shaft 80 under the influence of the centrifugal force generated by the rotation of the sleeve bearing 40 and then escapes to the oil buffer 90 through the clearance defined between the top end of the sleeve bearing 40 and the shaft 80. The slot 84 of the shaft 80 prevents the oil from continuously creeping up along the shaft 80. The oil retaining ring 50 can sufficiently prevent the oil from leaking out of the oil buffer 90. Thus, the escaped oil is received in the oil buffer 90 and then flows back to the bearing hole of the sleeve bearing 40 through the channels 42 and the bottom end of the sleeve bearing 40. Therefore, the oil can be kept from leaking out of the sleeve bearing 40. On the other hand, the rotor 30 is arranged under the base 18, and the fixing tube 36 extends upwardly from the center of the hub 32 of the rotor 30; thus, the bottom end of the fixing tube 36 is closed. The sleeve bearing 40 mounted in the fixing tube 36 thus has a sealed bottom end, and the oil can not leak out from the bottom end of the sleeve bearing 40 due to gravity when the cooling fan is in use. Thus, by the arrangement of the bearing 40 on the rotor 30 and the shaft 80 on the fan housing 10, even if the rotor 30 is located under the base 18 during a normal use of the cooling fan, the bottom end of the bearing 40 is sealed by the fixing tube 36 of the rotor 30 to avoid escape of the oil by gravity. Good lubrication of the sleeve bearing 40 and shaft 80 is thus consistently maintained, which enables the cooling fan to run smoothly, stably and with less vibration, thereby improving the quality and life-span of the cooling fan.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. A cooling fan comprising:

a fan housing having a shaft seat extending downwardly therefrom;

a shaft having a top end being fixedly connected to the shaft seat of the housing and a free end extending downwardly from the shaft seat;

a stator being fixedly mounted around the shaft seat of the fan housing;

a rotor comprising:

a hub having a plurality of blades extending radially and outwardly therefrom; and a fixing tube extending upwardly from the hub, the fixing tube having an open top end and a closed bottom end, a fixing hole being defined in the fixing tube communicating with the open top end; and a sleeve bearing being fixedly received in the fixing hole of the fixing tube to rotate with the rotor during operation of the cooling fan, a bearing hole being defined in the sleeve bearing for extension of the free end of the shaft therethrough;

wherein the open top end of the fixing tube is higher than a top end of the sleeve bearing;

wherein the shaft defines an annular slot in a circular circumference thereof, near the top end of the shaft adjacent to the shaft seat of the fan housing, the slot being located higher than the top end of the sleeve bearing and between the top end of the sleeve bearing and the open top end of the fixing tube; and wherein an oil retaining ring is fixedly mounted in the open top end of the fixing tube to enclose the open top end of the fixing tube, and an oil buffer is defined among the fixing tube, the sleeve bearing, the oil retaining ring and the shaft.

2. The cooling fan as claimed in claim 1, wherein a middle portion of the sleeve bearing has an inner diameter larger than that of two opposite ends of the sleeve bearing, and a space is defined between the middle portion of the sleeve bearing and the shaft for improving a supply of lubrication oil to the sleeve bearing.

3. The cooling fan as claimed in claim 1, wherein a plurality of channels communicating with the bearing hole are defined in an outer surface of the sleeve bearing.

4. The cooling fan as claimed in claim 1, wherein an annular protrusion extends inwardly from an inner surface of the bottom end of the fixing tube, and the sleeve bearing is arranged on the protrusion.

5. The cooling fan as claimed in claim 4, wherein a locking washer is arranged between the sleeve bearing and the protrusion of the fixing tube, the shaft defining an annular notch near the free end thereof, the locking washer engaging into the notch of the shaft to limit relative motion of the shaft and the sleeve bearing along an axial direction thereof.

6. A cooling fan comprising:

a fan housing having a shaft seat extending downwardly therefrom;

a shaft having a top end being fixedly connected to the shaft seat of the housing and a free end extending downwardly from the shaft seat;

a stator being fixedly mounted around the shaft seat of the fan housing;

a rotor comprising:

a hub having a plurality of blades extending radially and outwardly therefrom; and a fixing tube extending upwardly from the hub, the fixing tube having an open top end and a closed bottom end, a fixing hole being defined in the fixing tube communicating with the open top end; and a sleeve bearing being fixedly received in the fixing hole of the fixing tube to rotate with the rotor during operation of the cooling fan, a bearing hole being defined in the sleeve bearing for extension of the free end of the shaft therethrough;

wherein a middle portion of the sleeve bearing has an inner diameter larger than that of two opposite ends of the sleeve bearing, and a space is defined between the middle portion of the sleeve bearing and the shaft for improving a supply of lubrication oil to the sleeve bearing.

7. A cooling fan comprising:

a fan housing having a shaft seat extending downwardly therefrom;

a shaft having a top end being fixedly connected to the shaft seat of the housing and a free end extending downwardly from the shaft seat;

a stator being fixedly mounted around the shaft seat of the fan housing;

a rotor comprising:

a hub having a plurality of blades extending radially and outwardly therefrom; and a fixing tube extending upwardly from the hub, the fixing tube having an open top end and a closed bottom end, a fixing hole being defined in the fixing tube communicating with the open top end; and a sleeve bearing being fixedly received in the fixing hole of the fixing tube to rotate with the rotor during operation of the cooling fan, a bearing hole being defined in the sleeve bearing for extension of the free end of the shaft therethrough;

wherein an annular protrusion extends inwardly from an inner surface of the bottom end of the fixing tube, and the sleeve bearing is arranged on the protrusion.

8. The cooling fan as claimed in claim 7, wherein a locking washer is arranged between the sleeve bearing and the protrusion of the fixing tube, the shaft defining an annular notch near the free end thereof, the locking washer engaging into the notch of the shaft to limit relative motion of the shaft and the sleeve bearing along an axial direction thereof.

* * * * *